US007408109B1

(12) United States Patent
Freitas

(10) Patent No.: US 7,408,109 B1
(45) Date of Patent: Aug. 5, 2008

(54) CAPACITIVE ELECTRIC MUSICAL INSTRUMENT VIBRATION TRANSDUCER

(76) Inventor: Paul John Freitas, 942 Pellegrini St., Santa Cruz, CA (US) 95062

( * ) Notice: Subject to any disclaimer, the term of this patent is extended or adjusted under 35 U.S.C. 154(b) by 190 days.

(21) Appl. No.: 11/354,495

(22) Filed: Feb. 15, 2006

Related U.S. Application Data

(63) Continuation of application No. 10/710,782, filed on Aug. 2, 2004, now abandoned.

(51) Int. Cl.
*G10H 3/00* (2006.01)

(52) U.S. Cl. ..... 84/723; 84/687

(58) Field of Classification Search ..... 84/723, 84/733, 687
See application file for complete search history.

(56) References Cited

U.S. PATENT DOCUMENTS

| | | | | |
|---|---|---|---|---|
| 2,222,057 | A | 11/1940 | Benioff | |
| 2,455,575 | A | 12/1948 | Fender et al. | |
| 3,073,203 | A | 1/1963 | Evans | |
| 3,291,887 | A | 12/1966 | Carman | |
| 3,509,264 | A | 4/1970 | Green | |
| 3,956,959 | A | 5/1976 | Ebihara et al. | |
| 4,468,999 | A * | 9/1984 | Bonanno | 84/687 |
| 4,700,602 | A | 10/1987 | Bozzio | |
| 4,750,397 | A | 6/1988 | Ashworth-Jones | |
| 4,852,443 | A * | 8/1989 | Duncan et al. | 84/733 |
| 5,430,245 | A | 7/1995 | Rogers | |
| 5,633,473 | A | 5/1997 | Mori et al. | |
| 6,373,264 | B1 * | 4/2002 | Matsumoto et al. | 324/667 |
| 6,784,352 | B2 | 8/2004 | Suenaga | |
| 6,846,980 | B2 * | 1/2005 | Okulov | 84/646 |
| 2004/0118269 | A1 | 6/2004 | Yoshino | |

* cited by examiner

*Primary Examiner*—Lincoln Donovan
*Assistant Examiner*—Jianchun Qin

(57) ABSTRACT

A capacitive electric musical instrument vibration transducer contains one or more parallel plate variable capacitors. Each variable capacitor contains one vibrating variable capacitor plate, an electrically conducting surface that comprises, covers, or is embedded within an acoustically emitting vibrating surface on a musical instrument (such as a drumhead or soundboard), and one fixed variable capacitor plate comprising a rigid electrically conducting surface held a fixed distance away. When the instrument is played, the vibrating surface causes vibrations directly (without using airborne sound as an intermediary) in the vibrating variable capacitor plates, thus causing time-varying voltage oscillations in the parallel plate variable capacitors reflecting the vibrational state, and therefore the sound, of the instrument. An electric circuit in the transducer converts these voltage oscillations into the same kinds of signals produced by microphones and magnetic pickups.

18 Claims, 15 Drawing Sheets

CAPACITIVE ELECTRIC MUSICAL INSTRUMENT VIBRATION TRANSDUCER

CROSS-REFERENCE TO RELATED APPLICATIONS

This is a continuation of U.S. patent application Ser. No. 10/710,782, filed Aug. 2, 2004, now abandoned.

BACKGROUND OF INVENTION

This invention relates generally to the field of musical instruments, more particularly to a capacitive electric musical instrument vibration transducers better adapted to interface acoustic musical instruments with electronic recording and amplification equipment. (A musical instrument vibration transducer is sometimes referred to as a pickup, but that term will not be used to refer to the invention presented here to avoid confusion with electric guitar pickups and similar devices which, unlike this invention, are magnetic in nature.) There are three different general categories of musical instruments in common usage at the time of this writing: acoustic, electronic and electric. This invention relates to the first category, and aims to give acoustic instruments many of the advantages of the other instrument types. For completeness, all three categories will be discussed here.

Note that the primary emphasis of the discussion will be on percussion instruments, although this invention can be used on other types of instruments as well, including those that use some form of soundboard for sound propagation. These two categories of instruments have much in common; a percussion instrument can be understood as a soundboard stimulated by direct impact, and a banjo (a soundboard-instrument) uses a membrane as its soundboard that is essentially a drumhead in terms of its construction and mounting. In discussing the three general types of instruments, we will examine percussion instruments first, then examine the similarities between the percussion and soundboard instruments.

Acoustic percussion instruments include a number of different types of drums (such as snare, tom, bass, conga, djembe, etc.) as well as cymbals (such as hi-hat, crash, ride, gong, etc). Acoustic percussion instruments can be widely varied, such as temple blocks and cowbells, but drums and cymbals are of particular interest to musicians. Usually a number of acoustic percussion instruments are placed together in sets to be used by a single musician. Such sets of instruments are often known as drumsets, and the musician playing them known as a percussionist or drummer.

Drums typically consist of a shell (a hollow open-ended cylinder made of materials such as wood, metal, and plastic) capped on one or both ends by a drumhead (a thin, flexible disc made of materials such as plastic or animal hide). Drumheads are typically held in place by metal hoops that are secured to the shell by tension rods screwed into metal lugs. Acoustic drums are played by striking one or both heads with hands, sticks, brushes, beaters, rods, and other such devices.

Acoustic cymbals are typically discs made of metals such as bronze or brass, often mounted on stands by holes in their centers. Cymbals can also be mounted on their perimeter (like gongs). They have been carefully machined and hammered to provide certain sounds in response to activating actions, for example when played by devices such as sticks, mallets, brushes, rods, or bows, or when brought into rapid contact with one another (as in the case with hi-hat cymbals).

Acoustic percussion instruments generally interface with electronic recording and amplification systems through microphones. There are two different techniques used to record percussion sounds: close miking, where one or more microphones are placed close to each percussion instrument to capture their sounds individually, and distance miking, where fewer microphones are placed further away from the set of instruments to capture their sounds collectively.

Close miking is often more desirable because it captures individual instrument sounds more accurately, which allows more precise mixing of percussion sounds in production. It is also more complicated, due to the number of microphones needed. In close miking double-headed drums like snare drums, for example, two microphones are needed for each drum, one for each drumhead. Close miking can be very costly, especially if high quality microphones are required (as is often the case for cymbals). Distance miking is less costly and complicated, but it offers less control of instrument sounds while mixing for recording and/or amplification. Distance miking is also more likely to pick up noises from the surroundings (like other instruments, vocals, crowd noise, etc.) and make the final musical mix less clean than close miking.

A combination of close and distance miking are commonly used in live performances and recording sessions. For example, two close microphones may be used on snare drums, one for each drumhead, but only one close microphone on each tom and bass drum (even though these instruments are typically double-headed). Some loss of fidelity is experienced on toms and bass drums because the microphone only captures the sound from the head being struck, and even with close miking, the microphones can still pick up significant amounts of sound external to the drums being miked. For cymbals, one or two distant microphones are often used to capture their sounds collectively. The sounds of individual cymbals cannot be mixed individually, and other sounds (such as drum noise) are recorded as well.

Acoustic percussion instruments have a number of drawbacks. For greatest fidelity in an amplified performance or recording session, they require a large number of microphones, which can be quite expensive. Arranging these microphones requires great expertise, and can be quite time consuming. The fact that microphones can pick up significant amounts of external noise, such as other musical instruments or squeaking from a poorly lubricated bass drum pedal, can cause significant problems for sound engineers and percussionists. Another problem with acoustic instruments is that they can be very loud, often too loud for other musicians performing with a percussionist, or for neighbors of a percussionist practicing at home. Elaborate muting systems have been devised, such as erecting Plexiglas shields around drumsets or drumhead muffling systems like the invention of Suenaga, but these often change the sound of the instruments to an unacceptable degree. Using less force to play the instrument changes the playability of the instruments as well as their acoustic output, and is generally not a viable solution for volume problems.

Other acoustic musical instruments exist that propagate sound through a soundboard or its equivalent, which are referred to here collectively as soundboard instruments. These instruments include a number of stringed instruments like banjos, acoustic guitars, violins, lutes, mandolins, pianos, harps, and many others. These instruments may have a part of the instrument formally known as a soundboard, as the piano does, but many of these instruments use other parts of the instrument instead as a soundboard equivalent, such as the hollow body of an acoustic guitar or violin. In these instruments, vibrations are created in the soundboard or equivalent indirectly, generally by plucking, picking, hammering, or otherwise stimulating stretched strings attached to the soundboard or equivalent. The vibrating strings vibrate the soundboard or equivalent, which propagates the sound to the air more effectively than the vibrating strings do themselves. The banjo is particularly interesting in the context of this discussion because in terms of its construction, it is essentially a drum whose head, called a membrane, vibrates not by direct impact, but instead by the vibrations of stretched strings connected to the membrane through a bridge.

Soundboard instruments, like the acoustic percussion instruments discussed earlier, generally rely on microphones to interface with audio recording and amplification equipment. For this reason they suffer the same kinds of drawbacks that acoustic percussion instruments do. Piezoelectric devices known as contact pickups are sometimes used to sense vibrations over small areas of soundboards or their equivalents. The signal quality produced by contact pickups is generally poor, especially in terms of their low frequency response.

There are many examples of electronic percussion instruments, including the inventions of Mori et al. and Ebihara et al. These instruments do not produce musical sound directly, as acoustic instruments do. Instead, they use an electronic device (commonly referred to as a drum module) to produce electronic waveforms. These waveforms can be recordings of acoustic percussion instruments, recordings of other instrument sounds, or completely artificial waveforms produced by a synthesizer or other electronic device. These waveforms can be captured by recording or amplification equipment as if they were actual sounds captured by microphones.

Drum modules do not require a percussionist or drummer for operation. They can be operated through computer interfaces, electronic musical keyboards, or other electronic devices, although percussionists are frequently used. To simulate the instrument layout and feel of acoustic percussion instruments, a number of drum pads are typically employed. Drum pads typically feature a rubber or mesh head that can be played in a similar manner as a drumhead or cymbal, and are placed on stands around the drummer to simulate acoustic instrument placement conventions. The pads feature electronic mechanisms, typically called triggers, that sense vibrations on the pads consistent with the impact of sticks, hands, beaters, and such, and then send signals to the drum module to indicate that a particular waveform should then be emitted. Pads can feature multiple triggers to better simulate acoustic instrument behavior. For example, a pad meant to imitate a snare drum (like the one shown by Yoshino) might have two sensors, one in the center of the pad and one on the edge, which would allow the module to play ordinary drum beats, rim shots, and rim knocks depending on the signal received from the pad's multiple sensors. Triggers can also be impact sensitive, like the pressure transducer of Duncan et al., allowing drummers some measure of volume control.

Electronic drums are desirable for a number of reasons. They are much easier to set up than acoustic instruments because they don't need microphones. Drum sounds are sent directly from the drum module to recording or amplification equipment. They can play sounds that acoustic percussion instruments are physically incapable of producing. Also, electronic instruments can be played much more quietly than acoustic instruments. Because the sound produced by a drum module has nothing to do with the actual modes of vibration on the pads, electronic pads are generally made of materials that create little noise when struck, like rubber or taut nylon mesh.

Electronic percussion instruments have a number of drawbacks that make them unacceptable to large numbers of musicians. First and foremost, they lack the range and depth of acoustic instruments. The sound an acoustic instrument makes is unique every time it is played, because of factors such as instrument tuning, strike location, and so on. An electronic drum, on the other hand, generates an identically shaped waveform every time it is played. This repetitiveness can be unpleasant to many listeners. Adding extra triggers to pads (as Yoshino shows to allow triggering of rim shots), or making them pressure sensitive to change the volume at various times (as Duncan et al. shows), does little to alleviate this problem. Electronic percussion instruments also often lack the physical response characteristics (or "feel") of their acoustic counterparts, which can limit their playability.

The trigger mechanisms for electronic percussion instruments, including the inventions of Bozzio, Duncan et al., and others, have received much attention. It should be noted that these triggers, often known as drum pads, pressure transducers, piezoelectric pickups, and other similar names, are not used for the same purpose as microphones or magnetic pickups. When played, drum triggers produce a signal that triggers the drum module or equivalent to play a sound; they do not produce a microphone-like or magnetic pickup-like signal directly. The signal they produce is not intended to reproduce the sound of the triggering mechanism itself. For example, the invention of Duncan et al. is a pressure transducer that produces a non-oscillatory signal indicating the amount of pressure being applied to the triggering device by the percussionist as a function of time. These devices cannot be used without a drum module, synthesizer, or other such device, and are incapable of reproducing the (often undesirable) exact sound being emitted from the triggering device as a result of the triggering strike.

Soundboard instruments have their electronic counterparts as well, such as the electronic keyboard and (more rarely) electronic guitar-like devices. Again, they have an interface similar to their acoustic counterparts, but their output waveforms are based on sampled or electronically synthesized sounds from an electronic module within the instrument. They are often rejected by musicians and listeners for the same reasons electronic percussion instruments are rejected, including their repetitive output waveforms and their poor playability compared to their acoustic counterparts.

Acoustic musical instruments often have purely electric analogs, the most famous and commonly used being stringed instruments like electric guitars and basses, which use magnetic pickups (the invention of Fender is one example) to transduce metallic string vibrations into electric signals. Other electric analogs of soundboard instruments exist, such as electric violins, that use transducers (most commonly piezoelectric elements) on variants of the instrument bridge to detect string vibrations (as opposed to vibrations of an instrument's soundboard or other vibrating surfaces that actually produce the sound of the instrument), a combination which is often referred to as a saddle transducer. Ashworth-Jones, Carman et al., Benioff, and Evans all show examples of this general type of transducer. Neither magnetic pickups nor saddle transducers capture the vibrations of a soundboard or its equivalent; in fact, instruments with these kinds of transducers often lack a soundboard or equivalent entirely, and emit little sound directly. Consequently, electric stringed instruments do not sound like their acoustic counterparts, but instead have their own unique sounds. These electric instruments are used and valued for many reasons, but they are no substitute for their acoustic progenitors. Acoustic guitars and violins, for example, are still commonly found on concert stages and in recording studios for this reason.

Similarly, electric percussion instruments attempt to combine the playability and uniqueness of acoustic instruments with the implementation simplicity of electronic instruments. In a short analogy, an electric percussion instrument is to percussion what an electric guitar is to guitars. Various models have been proposed, although none of them appear to be in widespread use at the time of this writing.

Some models, such as the invention of Rogers, use a conventional acoustic drumhead with a magnetic speaker cone placed underneath, which is wired to act as a microphone. These systems do not have the dynamic range of an ordinary microphone. Furthermore, the speaker cones tend to be so large that they cannot be used in double-headed drums, because they disrupt the sound waves inside drums to an unacceptable degree. It should also be noted that speakers can be quite heavy; acoustic drumsets are already heavy and bulky, so adding a heavy speaker-like microphone is undesirable.

Other proposed models, such as the invention of Green, involve magnetic pickups (magnets and coils of wire which detect changes in the magnet's position) to capture drumhead or cymbal vibrations. Pickup-based systems are at a disadvantage because they require special drumheads or cymbals that do not well emulate traditional acoustic drumheads or cymbals. Furthermore, the magnetic pickups tend to capture vibrations at a single point only, rather than sample the vibrational state of an entire cymbal or drumhead, as the sound from an acoustic instrument does. Furthermore, a single pickup is often very dense compared to a drumhead or cymbal. Placing a single pickup on a drumhead breaks the vibrational symmetry of the head, which tends to create a vibrational node (or dead spot) at that point. The single pickup can thus destroy the vibrational fidelity of a drumhead. The vibration of a whole drumhead or cymbal requires an impractical and costly number of pickups, as well as a complicated mixing apparatus.

SUMMARY OF INVENTION

It is an object of the invention to provide for musical instruments a capacitive electric vibrational transducer that better represents and isolates the sound of the instrument than microphones or magnetic pickups can. This capacitive electric vibrational transducer uses the sound emitting vibrating surfaces on musical instruments to generate signals for recording or amplification purposes, thus combining many of the advantages of acoustic, electric, and electronic instruments. These waveforms are to be generated by adding a capacitive electric vibration transducer to these instruments that generates its signal using one or more parallel plate variable capacitors. Each of these variable capacitors has one vibrating variable capacitor plate that comprises, covers, or is embedded within vibrating portions of the instrument that emit sound waves when the instrument is played (such as a drumhead, soundboard, hollow instrument body, or banjo membrane). The other capacitor plate, called the fixed variable capacitor plate, is mounted in close proximity and parallel to the vibrating variable capacitor plate in such a way that is largely immune to instrument vibrations. These parallel plate variable capacitors are to be charged to a specific DC voltage by a power supply, and power is applied through a source of electrical resistance known as a biasing resistor, whose value is chosen to give the transducer specific frequency response characteristics. When the instrument is played, vibrations in the instrument continuously and directly (without using airborne sound as an intermediary) change the capacitance of the variable capacitors by bending one of their plates, thus creating time-varying voltage oscillations in the variable capacitors directly corresponding to the vibrational state of the vibrating surface, and thus corresponding to the sound of the instrument. These voltage oscillations can be sent through an electronic circuit to create signals of the exact same type produced by microphones and magnetic pickups. No drum module or synthesizer of any kind is needed to convert the signal from the vibration transducer into an audio signal directly suitable for recording or amplification. A preamplifier is frequently used to decrease the impedance of the output signal, but it is not always necessary.

It is another object of the invention to provide an electric musical instrument transducer whose signal output is more independent of the amount of sound the instrument emits than that of microphones. For example, the volume level of a drum can depend on many factors, including the materials used in the construction of its heads and the presence of muting devices, such as tape or fabric, attached to its heads. This invention can be constructed to produce an equally strong signal on both relatively loud and relatively quiet instruments. Acoustic instruments containing the invention may be made that are more suitable for use in quiet surroundings, including (but not limited to) apartment buildings, condominiums, and concert stages where microphones are needed for vocals or other instruments.

Yet another object of the invention is to provide electric musical instrument vibration transducers that can be produced and sold at a lower cost than traditional microphones. By integrating the transducer into acoustic instruments during the manufacturing process, customers can realize cost savings as well as greater reliability, fidelity of signal, application flexibility, and setup simplicity.

Another object of the invention is to give musicians more signal output options with less equipment than they might otherwise need. For example, guitarists value the sound of both acoustic guitars and electric guitars, even though they sound very different. It is not unusual for a guitarist on a concert tour, for example, to play both types of guitar at different times during a performance. This means that a guitarist must have one of each type of guitar available on stage, which also means packing two separate, bulky instruments, plus all of their associated microphones, instrument cables, amplifiers, and so forth, for the tour. The invention presented here, as shown below, can eliminate the need for a separate, complicated microphone apparatus for acoustic guitars and, at the same time, can be made to give a single acoustic guitar the ability to generate an electric guitar-like signal at the flip of a switch. The increased simplicity and reduction in necessary equipment can be very valuable for traveling musicians with limited assistance and resources.

One of the most significant objects of the invention is to create a transducer for acoustic instruments that is less sensitive to ambient noise than conventional microphones. The invention will create its output signals from the vibrations of its sound emitting surfaces directly, without using sound as an intermediary, thus blocking a large amount of ambient noise from the output signal. Acoustic musical instruments can respond audibly to ambient noise, as is evident from the phenomenon known as snare buzz, where a snare drum's resonant head buzzes in response to noise from another drum, musical instrument, speaker, or other noise source placed nearby. Still, ambient noise reduction can be significant compared to conventional miking techniques, which can be a valuable effect for musicians and sound engineers.

A fuller understanding of the nature of the objects of the present invention will become apparent upon consideration of the following detailed description taken in connection with the accompanying drawings, wherein:

DETAILED DESCRIPTION

Four different embodiments of the invention are described below: a double-headed drum with electric vibration transducer, a cymbal with electric vibration transducer, an acoustic guitar with electric vibration transducer and acoustic/electric signal switch, and a piano with electric vibration transducer. Note that there are many instruments with strong structural similarities to those described below, so the number of instrument types that can benefit from the capacitive electric vibration transducers described here is vast.

Figure 1:
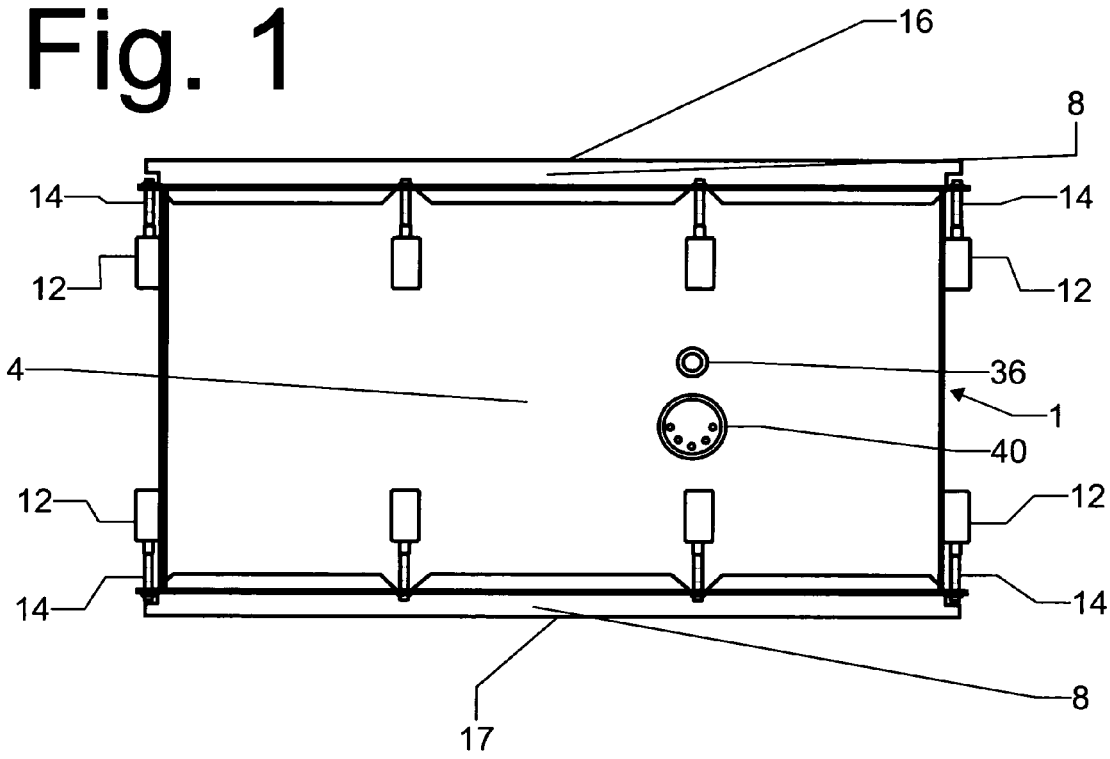
FIG. 1 is a side view of a double-headed drum with electric transducer, one embodiment of the invention.

Referring now to the drawings, FIG. 1 depicts an embodiment of the invention, a double-headed drum with electric transducer 1. It consists of a cylindrical shell assembly 4 capped on top by a batter drumhead assembly 16, and on the bottom by a resonant drumhead assembly 17. In this embodiment, the shell assembly 4 is circular, approximately 12 inches in diameter and 10 inches in depth. The drumhead assemblies 16 and 17 are held taut on the drum by metal hoops 8, which are attached to the shell assembly by threaded tension rods 14 screwed into metal lugs 12. In this embodiment, there are six evenly-spaced lugs per shell end attached to the shell assembly. FIG. 1 also depicts an audio output jack 36, which is used to connect the drum to industry standard recording and amplification equipment. In this embodiment, the audio connection is through a standard ¼" unbalanced instrument cable (not shown) that plugs into the audio output jack 36. Power is supplied to the drum through the power input port 40, which connects to widely available grounded DC power supplies through a 5-pin DIN cable (not shown) attached to the power supply (not shown).

Figure 2:
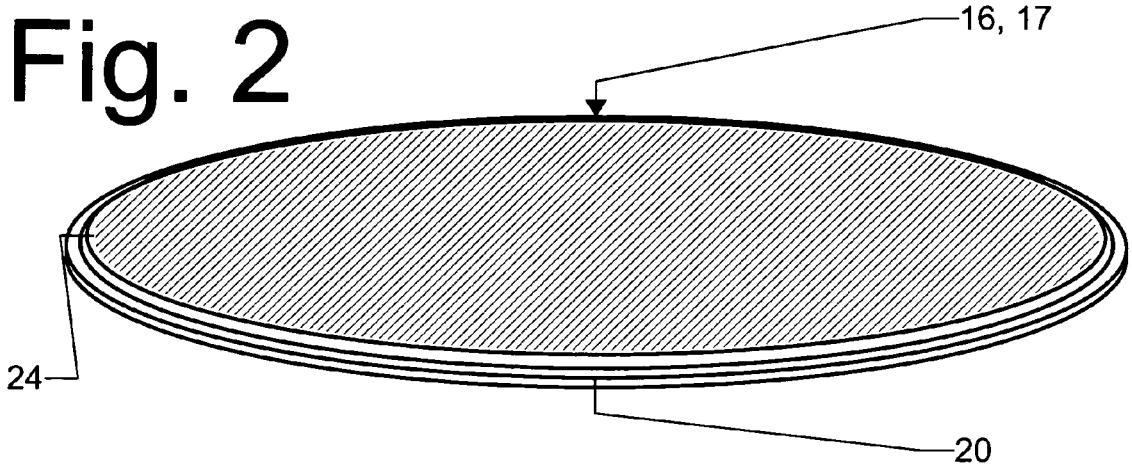
FIG. 2 is a perspective view of a batter drumhead assembly.
Figure 3:
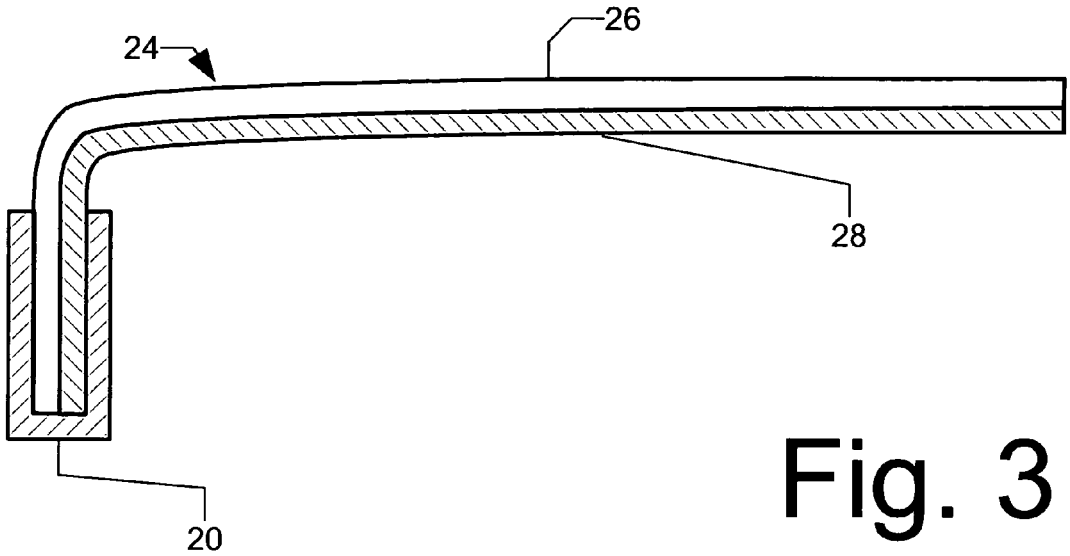
FIG. 3 is a cross-sectional view of a batter drumhead assembly.

FIG. 2 depicts a perspective view of a batter drumhead assembly 16. A drumhead ring 20 (made of a metal such as aluminum or steel in this embodiment, but not limited to metal in its construction) is attached to a layered drumhead surface 24 by means of friction and an adhesive material like epoxy resin. To better understand the composition of a drumhead assembly, FIG. 3 shows the batter drumhead assembly 16 in cross-section. In this embodiment, the surface layer 26 is a thin layer (typically several mils or less) of a plastic film, such as polyester. Directly beneath in the figure is the vibrating variable capacitor plate 28, made of a conducting material (such as aluminum foil or a layer of metal applied through the process known as metallization) that is bonded to the surface layer 26 with, in this case, a thin layer of pressure sensitive adhesive. The vibrating variable capacitor plate 28 need not be perfectly continuous; a number of holes may be included in the vibrating variable capacitor plate 28, provided they do not adversely affect the signal quality produced by the vibration transducer. The surface layer 26 and the vibrating variable capacitor plate 28 fit into a U-channel in the drumhead ring 20, and may be attached to the drumhead ring 20 by means of an adhesive or other means, including (but not limited to) friction caused by a tight fit between the layers of the drumhead and the drumhead ring 20. Electrical contact between the vibrating variable capacitor plate 28 and drumhead ring 20 may be desirable, but not absolutely necessary in this embodiment of the invention.

Note that the drumhead surface in this embodiment is a multilayer material, but it can be made of one layer of a conductive material such as metal, depending on the acoustic and durability characteristics desired by the user.

FIG. 3 also depicts the resonant drumhead assembly 17. In this embodiment the two drumhead assemblies are identical except for the thicknesses of their surface layer 26. Here the surface layer 26 of a resonant drumhead assembly 17 is thinner than that of a batter drumhead assembly 16, although this need not be true generally. Like in the batter drumhead assembly 16, the drumhead surface need not be a multilayer material, nor does it need to be constructed similarly to that of the batter drumhead assembly 16.

Figure 4:
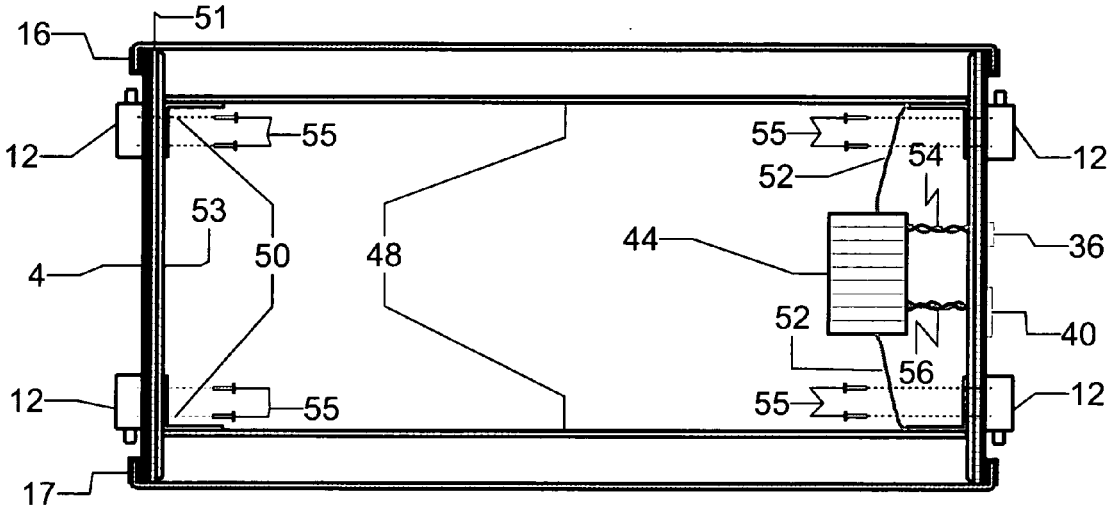
FIG. 4 is a cross-sectional view of a shell assembly with drumhead assemblies in place.

FIG. 4 depicts a cross-sectional view of the shell assembly in this embodiment. The shell body 4, which is cylindrical in shape, contains a ground layer 51 made from a conducting material (such as aluminum foil, a metalized fabric, or even a metal surface applied to the inside of the shell by metallization). The ground layer 51 has electrical contact with the metal lugs 12 through the mounting screws 55. The ground layer 51 also has electrical contact with the drumhead vibrating variable capacitor plates 28 by means of direct physical contact between them. An structural layer 53, made of wood in this embodiment, provides structure for the parts of the transducer as well as defining the acoustic properties of the drum. The sensor grid assemblies 48 are mounted on the shell body 4 by mounting brackets 50, which in turn are connected to the shell body 4 by the same mounting screws 55 that hold on the metal lugs 12. The mounting brackets 50 define the distance (in this case ½ inch) between the sensor grid assemblies 48 and the drumhead vibrating variable capacitor plate 28, and also prevent inadvertent electrical contact between the sensor grid assemblies 48 and other parts of the drum. The transducer wire 52 makes electrical contact between the electric circuit board 44 and the sensor grid assemblies 48 for purposes of voltage control and audio signal capture. The audio output jack 36 and power input port 40 (shown in FIG. 4 in cross section) are connected to the electric circuit board 44 by the output jack cable 54 and power input cable 56, respectively.

Figure 5:
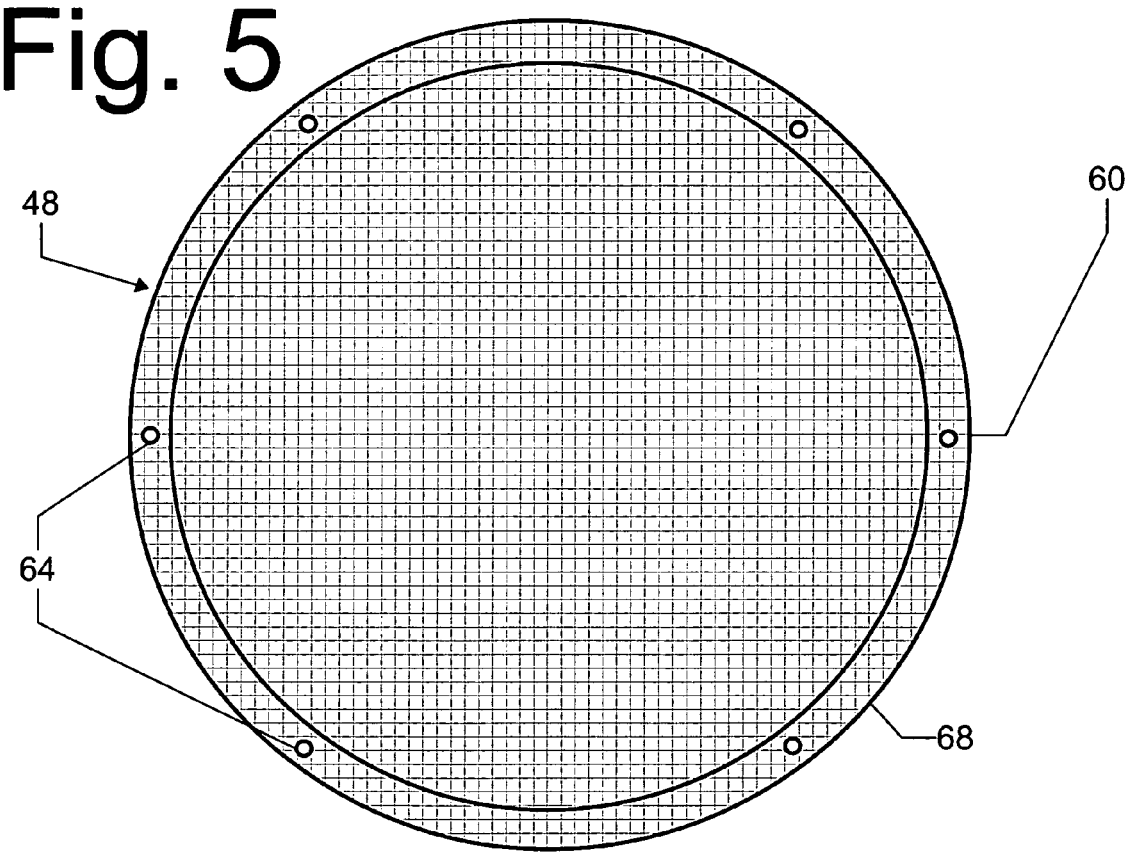
FIG. 5 is a top view of a sensor grid assembly.

FIG. 5 depicts a top view of a sensor grid assembly 48. In this embodiment, a sensor grid assembly 48 comprises a mounting ring 60 whose diameter is slightly smaller than that of the interior diameter of the drum shell body 4. A fixed variable capacitor plate 68, made from a material such as (but not limited to) welded copper hardware cloth, is stretched across the mounting ring 60 in such a way that the fixed variable capacitor plate 68 does not vibrate significantly during instrument play at audio frequencies (20-20,000 Hertz). In this embodiment, the mounting ring 60 is made of ¼ inch thick plywood, and the fixed variable capacitor plate 68 is attached with numerous staples. Evenly spaced holes 64 are drilled in mounting ring 60 to allow the sensor grid assembly 48 to be affixed to mounting brackets 60. The transducer wire 52 is attached to the fixed variable capacitor plate 68 and the electric circuit board 44 with solder or an appropriate solderless connector system.

Figure 6:
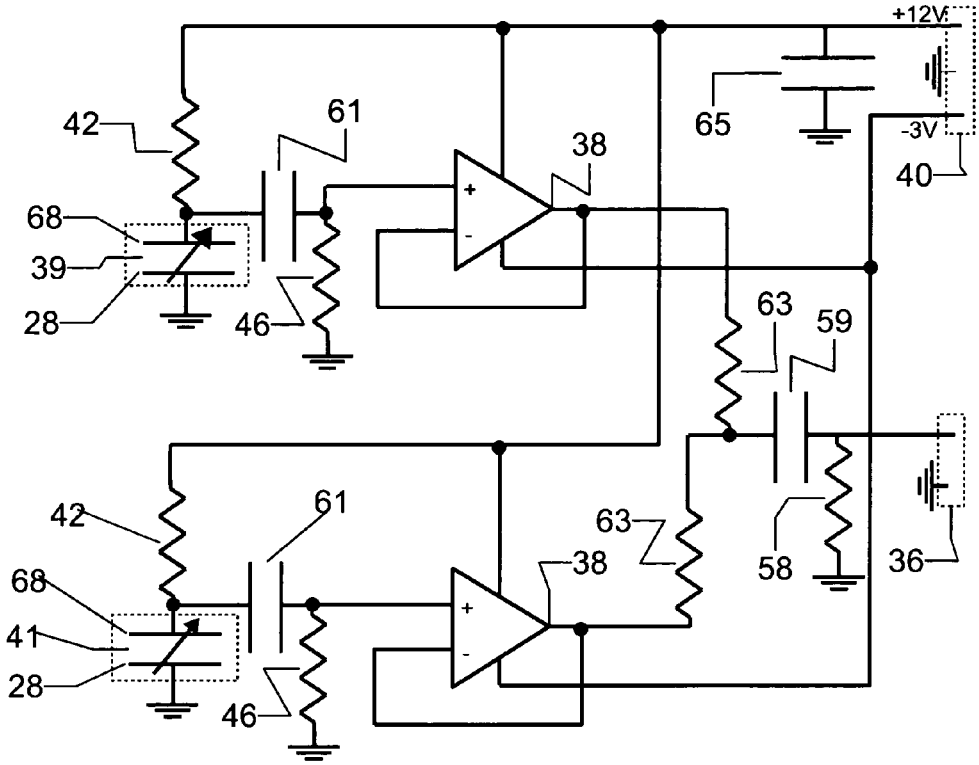
FIG. 6 is a schematic view of an electric circuit board for an electric double-headed drum transducer.

FIG. 6 is a schematic view for an electric circuit board 44. The power input port 40 comprises 3 terminals providing an electrical ground, a positive voltage (such as 12V above ground) and a negative voltage (such as 3V below ground). In this embodiment, there are two unused pins in the 5-pin DIN jack for the power input port 40. The positive power supply is connected to a filtering capacitor 65 to eliminate noise from the positive power supply; in this instance, the capacitor is a 1000 microfarad electrolytic capacitor capable of withstanding at least 24V. The audio output jack 36 comprises two terminals, one carrying the audio output signal of the drum (the "tip" terminal) and the other carrying ground (the "sleeve" terminal). The ground terminal of the audio output jack 36 is in direct contact with the ground layer 51 of the shell body 4, thus setting the ground for the drumhead vibrating variable capacitor plates 28 as well. The audio output signal is generated by the batter variable capacitor 39 and the resonant variable capacitor 41. The batter variable capacitor 39 comprises the drumhead vibrating variable capacitor plates 28 of the batter drumhead assembly 16 and the fixed variable capacitor plate 68 of the corresponding sensor grid assembly 48. Likewise, the resonant variable capacitor 41 comprises the drumhead vibrating variable capacitor plate 28 of the resonant drumhead assembly 17 and the fixed variable capacitor plate 68 of the corresponding sensor grid assembly 48. A voltage difference across the variable capacitors 39 and 41 is maintained by a connection from the positive power supply through a biasing resistor 42 whose value, in this instance, is 90 kilohms. The transducer wire 52 connects the fixed variable capacitor plate 68 to the resistor 42, thus establishing a voltage difference, in this embodiment, of 12V across variable capacitors 39 and 41 with a source resistance 46 of 1 megohm. The audio signal originates as voltage fluctuations on the fixed vibrating variable capacitor plates 68 as the vibrating variable capacitor plates 28 vibrate when the instrument is played by the percussionist. These voltage oscillations, in this embodiment, are approximately proportional to the magnitude of the capacitance oscillations across their respective variable capacitors, the frequency of the capacitance oscillations, and the applied DC voltage (12V in this embodiment). The generated signals are routed through high pass filters consisting of blocking capacitors 61 (0.01 microfarads) and filter resistors 46 (100 kilohms), then through op amps 38, which in this embodiment are the two different op amps on the same TL072CP dual op amp device. These op amps 38 serve as preamplifier's for the final output signal, and may be omitted if the instrument is connected to recording or mixing devices through extremely short cables. Most users will prefer to have the preamplifier circuitry included, however, as they generally prevent significant signal loss. The two signals from the different variable capacitors 39 and 41 are mixed together by passing them through mixing resistors 63 (10 kilohms). The mixed signal is then fed through blocking capacitor 59 (10 microfarads) connected to resistor 58 (typically 100 kilohms) for high pass filtering and DC bias matching purposes. The final output signal of this embodiment of the transducer strongly resembles a signal from a high-quality microphone placed near the drum during play.

It should be noted that for most applications, only one variable capacitor is needed to accurately transduce the sound of the instrument. In these cases, one of the collector grids (along with all of the electronic circuitry associated with that variable capacitor in the electric circuit board) can be eliminated, thus significantly simplifying the construction of the vibration transducer. It should also be noted that the method of implementation described above can also be used to add an electric vibration transducer to a stringed soundboard musical instrument like the banjo, which can be regarded as a drum played by attached stretched strings. A banjo membrane, which is the soundboard equivalent for a banjo, is constructed and installed in almost exactly the same manner as a drumhead. In fact, drumhead manufacturers generally manufacture banjo membranes for banjo manufacturers, and their trademarks often appear prominently on their banjo membrane products, thus emphasizing how similar banjos and drums actually are in construction.

This embodiment of the invention uses industry standard instrument cable to convey a signal to recording or amplification equipment. The invention can be modified to convey the information in other forms. For example, circuitry and an antenna can be added to transmit the generated signal in the form of radio waves, as many wireless microphones do. If desired, the electric circuit board can be modified to include one of many analog to digital converters, including (but not limited to) a variety of freely available integrated circuits, and the resulting digital data can be transmitted in a variety of ways including signals on a dedicated digital cable, digitized data packets on networking equipment (both wired and wireless), and optical data streams on a fiber optic cable. Lastly, note that the preamplifier circuit can be adjusted to increase the gain to the output signal if necessary, including making the gain adjustable during instrument play.

Figure 7:
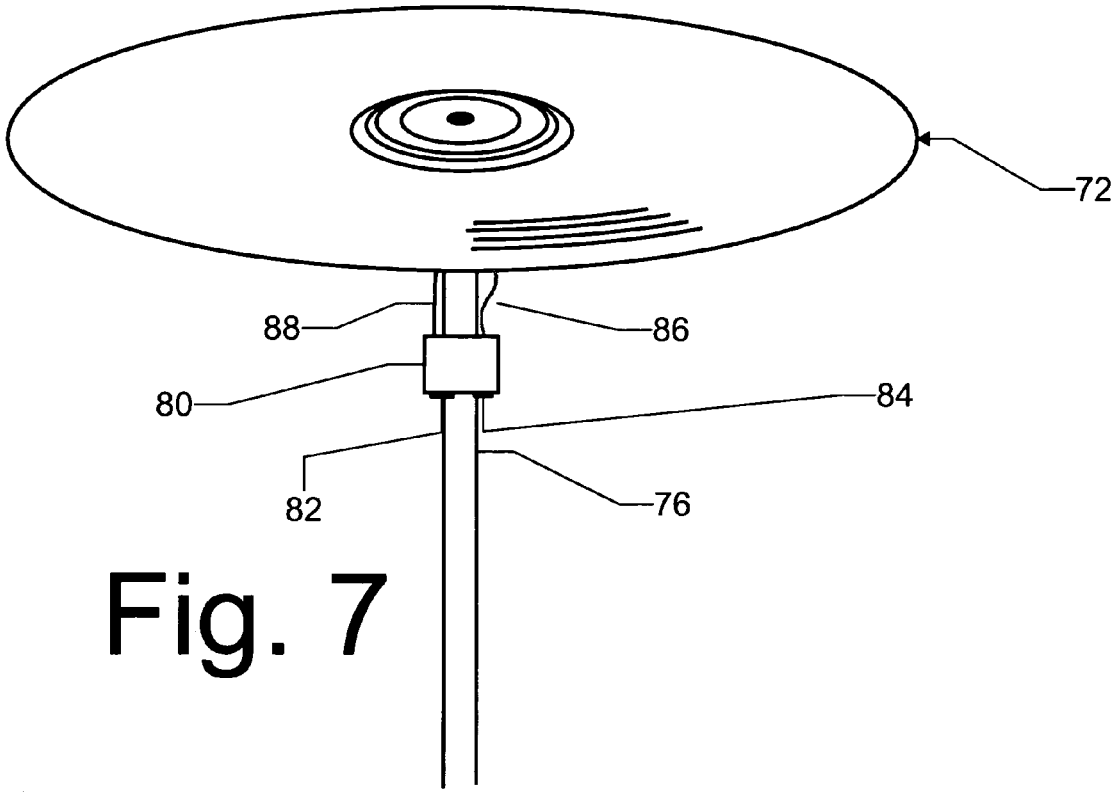
FIG. 7 is a perspective view of a cymbal with electric transducer, another embodiment of the invention.

FIG. 7 depicts a perspective view of a cymbal with electric transducer. In this embodiment, it comprises a cymbal assembly 72 mounted on a cymbal stand 76. An electric circuit board 80 is also attached to the cymbal stand, connected to the cymbal assembly 72 by a ground wire 88 and a transducer wire 86. The electric circuit board 80 is connected to an external grounded DC voltage source through a power port 82, and to recording or audio amplification equipment through its audio output port 84, to which a ¼" phone-type unbalanced instrument cable (not shown) is attached.

Figure 8:
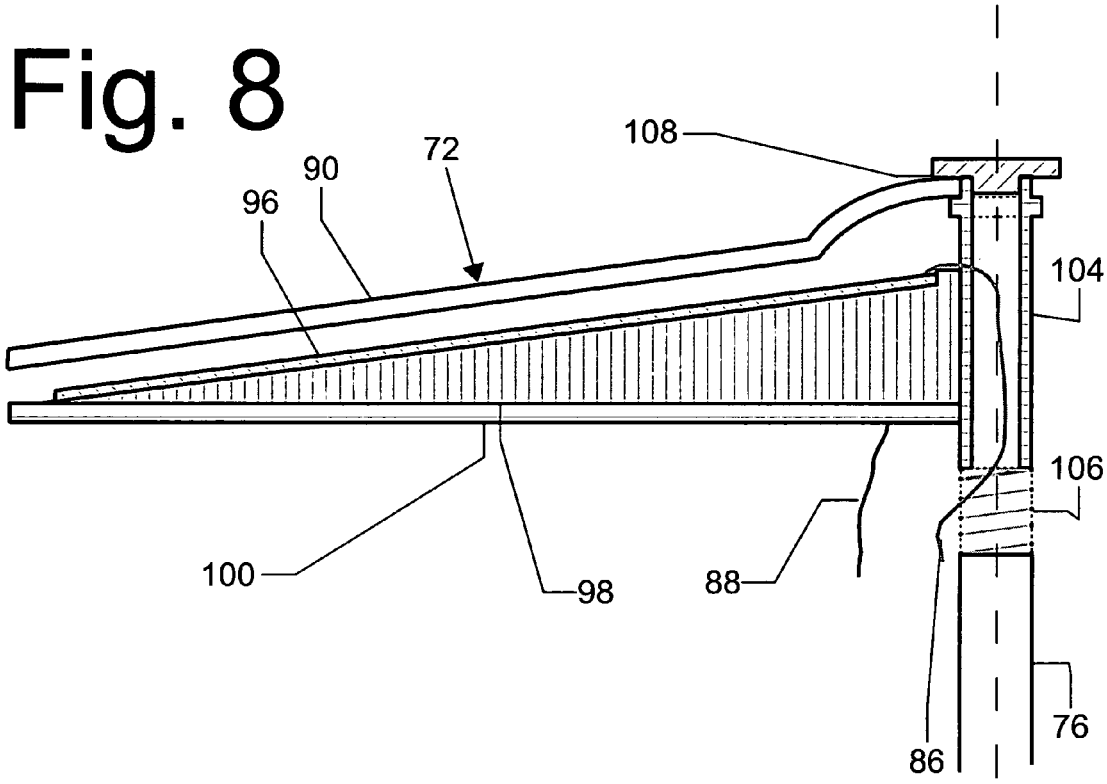
FIG. 8 is a cross-sectional view of a cymbal assembly.

FIG. 8 shows a more detailed, cross-sectional view of a cymbal assembly 72, from the outer edge of the assembly to the geometric center (denoted by a dashed line). Note that in this embodiment of the invention, the cymbal assembly is radially symmetric. The top surface of the cymbal assembly is the vibrating variable capacitor plate 90, and typically comprises an acoustic cymbal, a specially machined and hammered metallic disc (made from materials such as bronze or brass) that defines the acoustic signature of the cymbal when struck. The acoustic cymbal need not be manufactured in any special way for use with the transducer; any metallic cymbal made to be played by itself can be mounted on the cymbal assembly 72, provided it physically and electrically "fits." In this instance, the vibrating variable capacitor plate 90 is a 16 inch crash cymbal, available commercially from a variety of manufacturers. Directly beneath the vibrating variable capacitor plate 90, across a small air gap (approximately ¼" in this embodiment) created by the axle 104, is the fixed variable capacitor plate 96, which in this embodiment is made of 1 mil thickness aluminum foil, and is in electrical contact with the transducer wire 86. The fixed variable capacitor plate 96 adheres to a base layer 98 made from an electrically and acoustically insulating material such as polystyrene foam. The base layer 98 sits atop a ground layer 100, which in this embodiment is a relatively thick layer of metal such as aluminum. The ground layer is electrically grounded through the ground wire 88, connected to the electric circuit board 80, and is also welded to the axle 104. The metal cap 108, which screws into the threaded inside top of the axle 104, holds the center of the vibrating variable capacitor plate 90 tightly, thus providing electrical contact and grounding the cymbal.

FIG. 8 also shows that the aforementioned cymbal assembly layers are mounted on an axle 104, essentially a hollow metal cylinder. In addition to sustaining the air gap between the upper and lower conducting layers 94 and 96, the axle allows passage and connection of the transducer wire 86 through several holes. The axle 104 sits atop a coil spring 106, to allow the vibrating variable capacitor plate 90 to move freely after striking, but keeping it from colliding with other parts of the assembly. The coil spring 106 is mounted on top of a cymbal stand 76, which is of the same variety as those used by ordinary acoustic cymbals, and is available from a variety of manufacturers.

Figure 9:
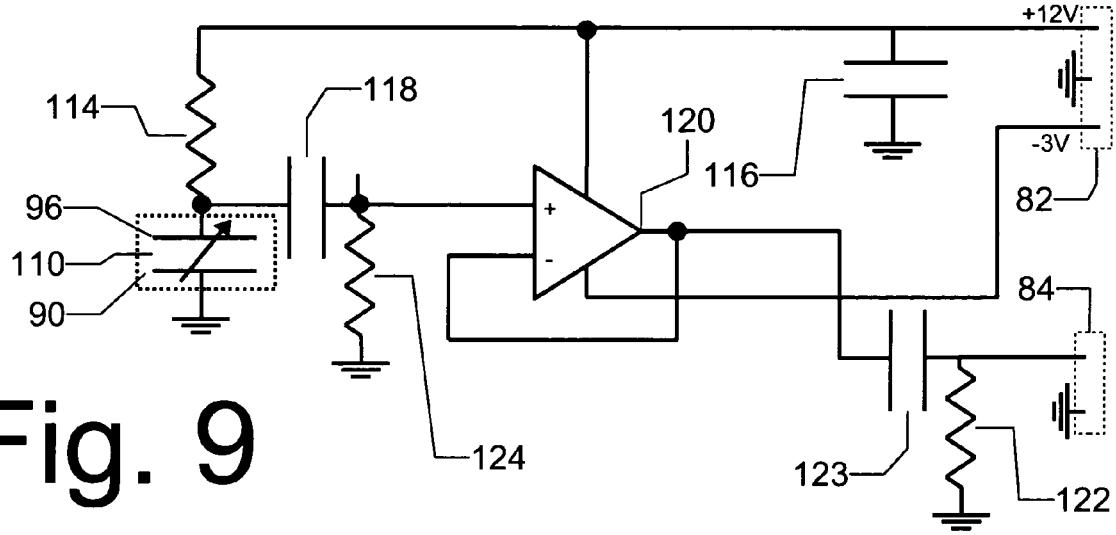
FIG. 9 is a schematic view of an electric circuit board for an electric cymbal transducer.

FIG. 9 is a schematic view of an electric circuit board 80 for a cymbal with electric transducer. The power input port 82 comprises 3 terminals providing an electrical ground, a positive voltage (such as 12V above ground) and a negative voltage (such as 3V below ground). For example, the 5-pin DIN connector and power supply used in the double-headed drum embodiment above may be used here also. In this embodiment, the positive power supply is filtered by an electrolytic filtering capacitor 116 of 1000 microfarads capacitance and rated for at least 24V. The audio output jack 84 comprises two terminals, one carrying the audio output signal of the cymbal (the "tip" terminal) and the other carrying ground (the "sleeve" terminal). The audio output signal is generated by the variable capacitor 110 comprising the vibrating variable capacitor plate 90 and the fixed variable capacitor plate 96 of the cymbal assembly 72. A voltage difference across the variable capacitor 110 is maintained by the positive power supply voltage (12V in this embodiment) passing through the resistor 96, whose value for this embodiment is 90 kilohms. It can be shown mathematically that for this embodiment of the vibration transducer, where the zero-vibration capacitance of the variable capacitor is around 80 picofarads, the voltage across the variable capacitor will vary proportional to the product of the capacitance fluctuations at the frequency of vibration of interest, the frequency itself, and the applied DC voltage. This frequency proportionality can be shown to exist for sufficiently low values of resistance 96 relative to the zero vibration capacitance of the variable capacitor 110, and in this case includes the entire audio spectrum (conventionally described as 20-20,000 Hertz). The audio signal appears as voltage fluctuations on the fixed variable capacitor plate 96 when the vibrating variable capacitor plate 90 vibrates after it is played by the percussionist. These voltage oscillations then pass through a high pass filter formed by capacitor 118 (here 0.01 microfarads) and resistor 124 (here 100 kilohms), and are preamplified by the op amp 120 (here a TL071CP). The generated signals are routed through another high pass filter formed by capacitor 123 (here 10 microfarads) and resistor 122 (here 100 kilohms) before being sent out of the instrument through a standard ¼" instrument cable (not shown) attached to the audio output jack 84.

As in the previous embodiment, although this embodiment of the invention uses industry standard instrument cable to convey a signal to recording or amplification equipment, the invention can be modified to convey the generated signal in other forms, including analog or digital signals using many different wired, wireless, or optical transmission media. Lastly, note that the preamplifier circuit can be adjusted to increase the gain to the output signal if necessary, including making the gain adjustable during instrument play.

Figure 10:
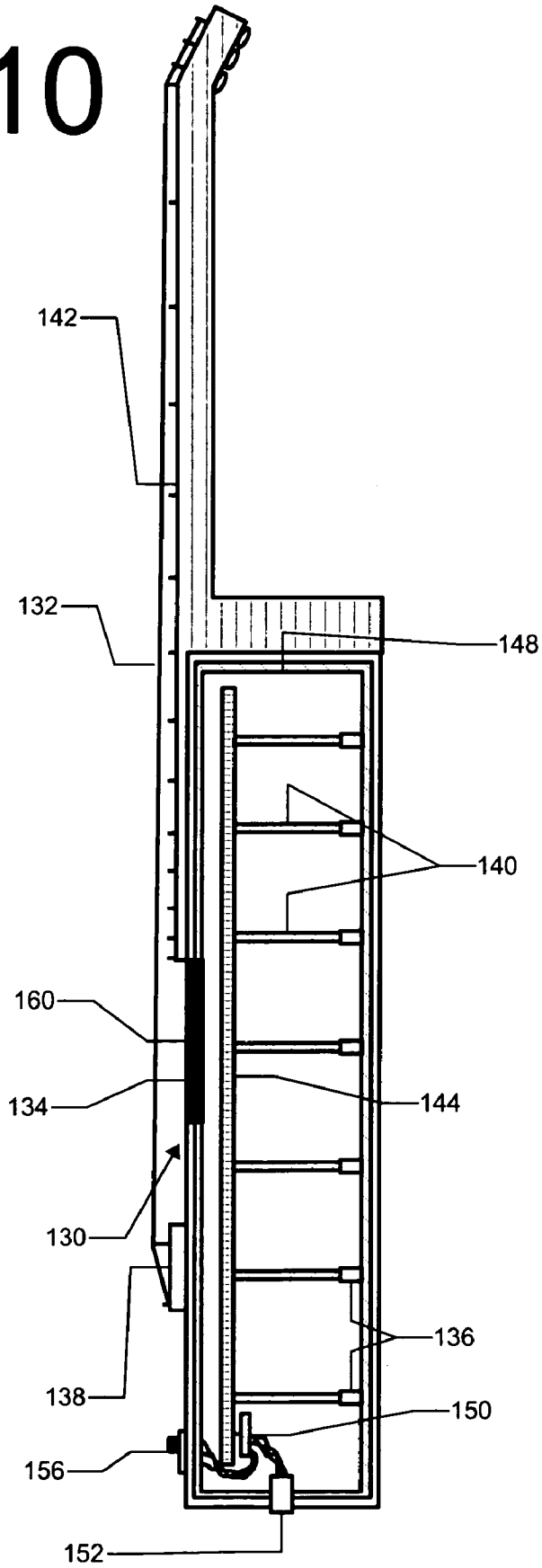
FIG. 10 is a cross-sectional view of an acoustic guitar with electric vibration transducer and acoustic/electric signal switch.

FIG. 10 shows a cross-sectional view of an acoustic guitar with electric vibration transducer and acoustic/electric signal switch, another embodiment of the invention. It should be noted that there are a large number of similar acoustic stringed instruments, including (but not limited to) stand-up bass, mandolin, violin, cello, ukulele, dobro, and many other such instruments, that have similar construction to the acoustic guitar. An electric vibration transducer can be fitted to these other instruments in a nearly identical manner to the method shown here for an acoustic guitar. Banjos have many similarities to guitars also, but their hollow bodies bear more resemblance to drums than guitars. The reader is referred to the double-headed drum with electric transducer embodiment above for electric banjo vibration transducer construction details.

In FIG. 10 we see many familiar elements of acoustic guitars. A plurality of stretched strings 132 are attached to a neck 142 and a bridge 138. Note that none of these components need to differ from those used traditionally for acoustic guitars in any way. The strings 132, for example, can be made from gut, nylon, metal, natural fibers, or other materials used for acoustic guitar strings. Traditional electric guitars use magnetic pickups and require metal strings, but such strings are not required here. The bridge 138 can be any kind of bridge typically used for acoustic guitars; it requires no piezoelectric elements or any other kind of electronic transducer, unlike other types of transducers. The neck 142 similarly requires no unusual construction for a guitar. It is the hollow instrument body 130 that houses the electric vibration transducer itself, and requires special construction.

The hollow instrument body 130 vibrates in response to vibrations on the stretched strings 132 caused by the instrument. These sympathetic vibrations in the instrument body 130 are then transmitted to the air in the form of sound waves heard by listeners nearby. (The vibrations of the strings 132 contribute very little to the sound emitted by the instrument, as their surface area is very small compared to that of the instrument body 130.) In this embodiment, the instrument body 130 consists of a wooden shell 134 constructed of hard wood (such as spruce), as is traditional for an acoustic guitar body. The interior of the shell is lined with a vibrating variable capacitor plate 148, which in this embodiment comprises a layer of aluminum foil 1 mil thick covering the entire interior of the wooden shell 134, with an adhesive used to bond the wood and aluminum foil together. It should be noted that the body need not be made of multiple layers; it may be constructed of a single electrically conducting material, such as (but not limited to) steel or aluminum, for example. In this embodiment, however, a multilayer design is used to give the instrument a traditional sound. Also in keeping with tradition, a large hole 160 is placed near the geometric center of the stringed face of the instrument body 130 to better enable the instrument to propagate sound. It should be noted that if direct sound propagation is a less valued characteristic of the instrument, the hole may be made arbitrarily small to reduce instrument volume during play. (A small hole should exist somewhere on the instrument for air pressure equalization, if for no other purpose.)

FIG. 10 also depicts a collector grid 144 placed in close proximity to the stringed face of the instrument on wooden posts 140 attached to structural supports 136 placed in the back of the instrument. In this embodiment, the structural supports 136 are made of wood. The distance between the collector grid 144 and the vibrating variable capacitor plate 148 is regulated by the length of the support posts, and said distance should be chosen to give the parallel plate variable capacitor a desired value while the instrument is not in play. In this embodiment, that value is 80 picofarads. The electric vibration transducer's electric circuit board 150 is mounted on the collector grid 144 in this embodiment. A number of wires make electrical contact between the electric circuit board 150, the collector grid 144, the XLR output jack 152, and the electric/acoustic signal switch 156. The XLR output jack 152 is an industry standard 3 terminal balanced and shielded male output jack that, in this instance, also brings power to the electric vibration transducer through DC bias on the signal lines, a power delivery system often referred to as "phantom power." It connects to a mixer or recording device through a shielded XLR cable (not shown) commonly used to carry signals from microphones. The acoustic/electric signal switch 156 is a simple two-position switch whose purpose will be discussed in greater detail below.

Figure 11:
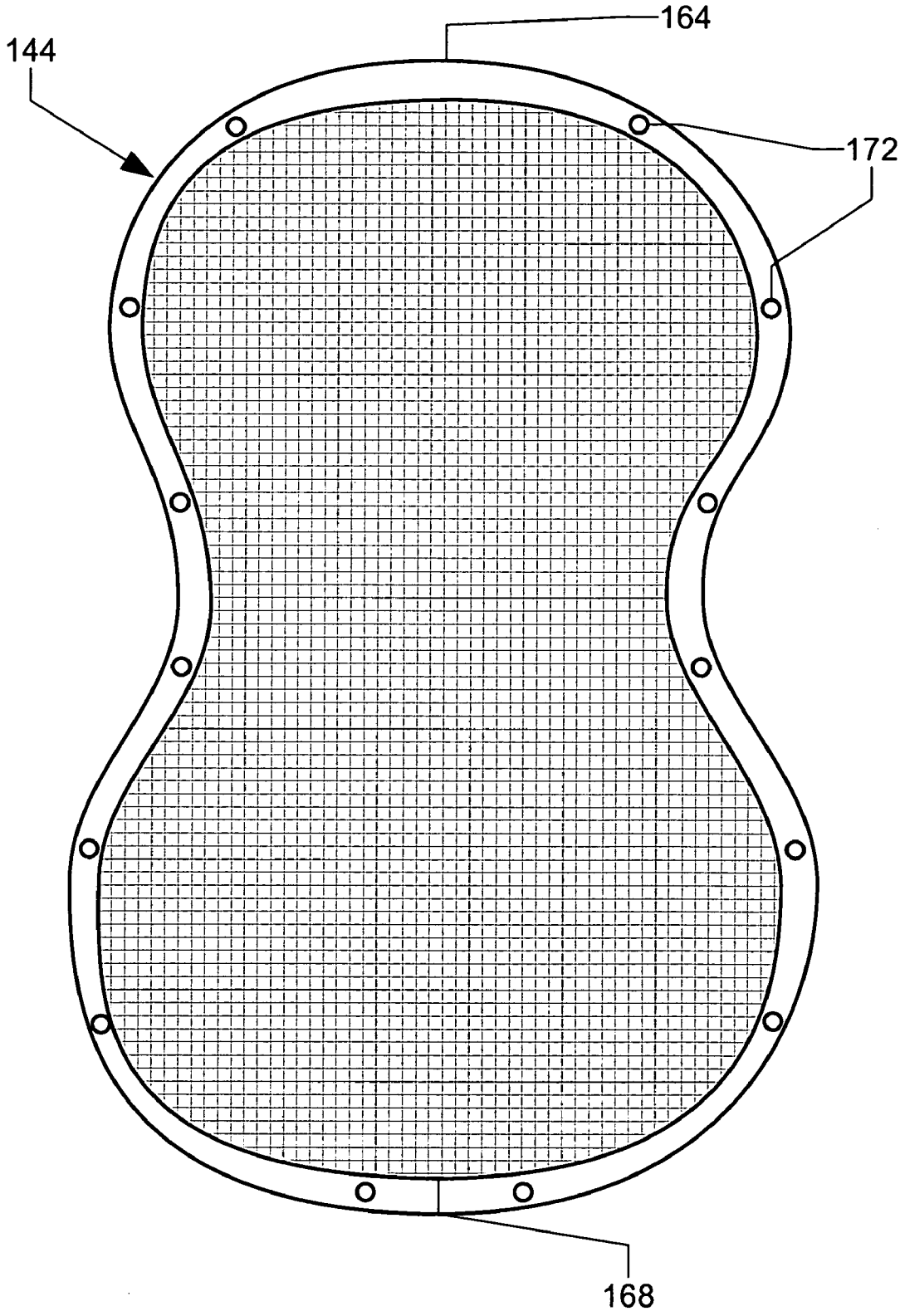
FIG. 11 is a top view of an acoustic guitar sensor grid assembly.

FIG. 11 depicts the collector grid 144 as viewed from the bottom. In this embodiment, the collector grid 144 comprises a fixed variable capacitor plate 168 stretched across a wooden frame 164 and secured with staples. The fixed variable capacitor plate 168 in this instance is made of a copper mesh material having a ¼" mesh spacing, but may have a larger or smaller spacing as desired, or even be made from other conducting materials. The fixed variable capacitor plate 168 is also covered by a layer of insulating plastic such as PVC to prevent accidental electrical shorting. A plurality of holes 172 allow the collector grid 144 to be attached to the posts 140 using wood glue or fasteners such as wood screws (not shown). It should be noted that it is possible to construct the electric circuit board 150 and the fixed variable capacitor plate 168 on a single, large printed circuit board of a similar shape to the frame 144 shown here. The shape of the frame can also be varied provided the transducer still produces adequate signal.

Figure 12:
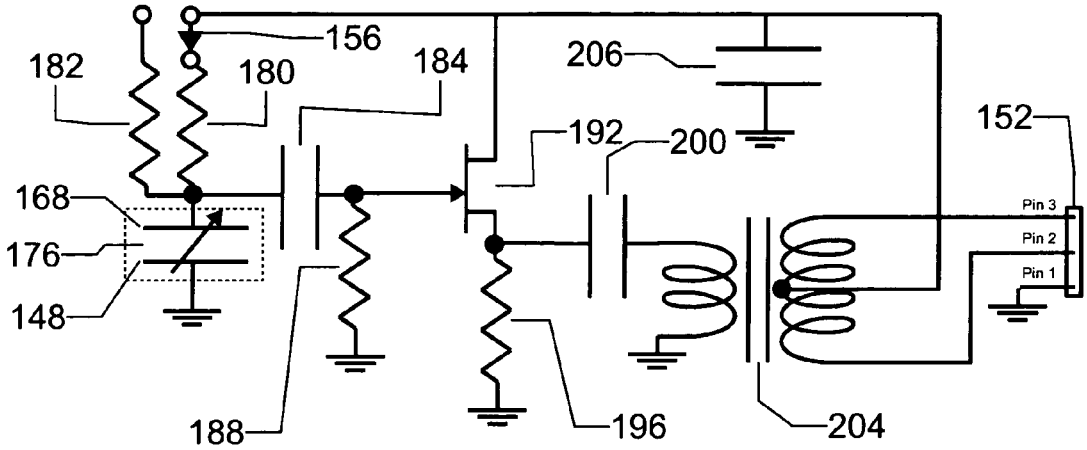
FIG. 12 is a schematic view of an electric circuit board for an acoustic guitar with electric vibration transducer.

FIG. 12 is a schematic view of the electric circuit board 150. The XLR output jack 152 provides signal output and DC power (as described above) through pins 2 and 3, which are connected to a 600 ohm matching transformer 204. A center tap on one side provides +48 volts of DC bias to the electric circuit; the other side of the transformer accepts the unbalanced signal output from a preamplifier as described below. Electrical grounding comes from pin 1 of the XLR output jack 152. It should be noted that a ¼" TRS balanced phone-type jack, often used for balanced signal transmission between audio equipment, can be used as a substitute for, and in exactly the same manner as, the XLR output jack 152. The positive power supply is filtered by filter capacitor 206, which in this embodiment is an electrolytic capacitor of 1000 microfarads value capable of withstanding 100V applied voltage. If necessary, diodes and resistors may be inserted between the filtering capacitor and its sources of positive voltage and ground to provide additional noise filtering and prevent overcurrent when the instrument is first connected to its output cable.

As mentioned previously, the hollow body's vibrating variable capacitor plate 148 and the collector grid's fixed variable capacitor plate 168 together create a parallel plate variable capacitor 176. The fixed variable capacitor plate 168 is connected to the positive power supply through one of two resistors, the acoustic biasing resistor 180 or the electric biasing resistor 182, the choice of which is determined by the position of the acoustic/electric signal switch 156. In this embodiment, the acoustic biasing resistor 180 has a value of 90 kilohms, and when connected causes the instrument to produce a signal at a certain frequency proportional to the magnitude of the capacitance oscillations in the parallel plate variable capacitor 176 at that frequency times the frequency itself and the applied DC voltage. With the acoustic biasing resistor 180 switched on, the output signal will sound very similar to the instrument itself when played through appropriate equipment, and the signal will strongly resemble the signal produced by a conventional microphone placed near the acoustic guitar. If the user instead switches the electric biasing resistor 182 into the circuit, whose value in this instance is 22 megohms, the instrument will produce a signal proportional only to the magnitude of the capacitance oscillations in the parallel plate variable capacitor 176 times the applied DC voltage. With the electric biasing resistor 182 selected, the output signal of the instrument will have the strong accentuation of the fundamental frequency commonly associated with electric guitars, and the signal will resemble the output signal of a magnetic pickup if one were placed on the guitar under the string being played. Thus, this acoustic guitar can produce a waveform like an acoustic or an electric guitar, depending on the setting of the acoustic/electric signal switch 156.

To prevent signal loss through the XLR cable (not shown), voltage oscillations in the collector grid's fixed variable capacitor plate 168 are transmitted through a blocking capacitor 184 (a polyester film capacitor of value 0.01 microfarads in this instance) to a JFET 192 that functions as a preamplifier. The JFET 192 in this instance is a 2N4338 low-noise JFET, and is biased at its gate by biasing resistor 196 having a resistance of 5.6 megohms in this embodiment. The quiescent current of JFET 192 is controlled by source resistor 196 whose resistance in this embodiment is 4700 ohms. The signal output of the preamplifier travels through blocking capacitor 200 (of capacitance 10 microfarads in this embodiment) and through the non-center-tapped winding of transformer 204, where it is output from the vibration transducer through the instrument cable (not shown) attached to XLR output jack 152. The signal appears as balanced (equal magnitude but opposite phase) voltage oscillations on wires attached to pins 2 and 3 of XLR output jack 152.

As in the previous embodiments, the invention can be modified to convey the generated signal in other forms, including analog or digital signals using many different wired, wireless, or optical transmission media. Lastly, note that the preamplifier circuit can be adjusted to increase the gain to the output signal if necessary, including making the gain adjustable during instrument play.

Figure 13:
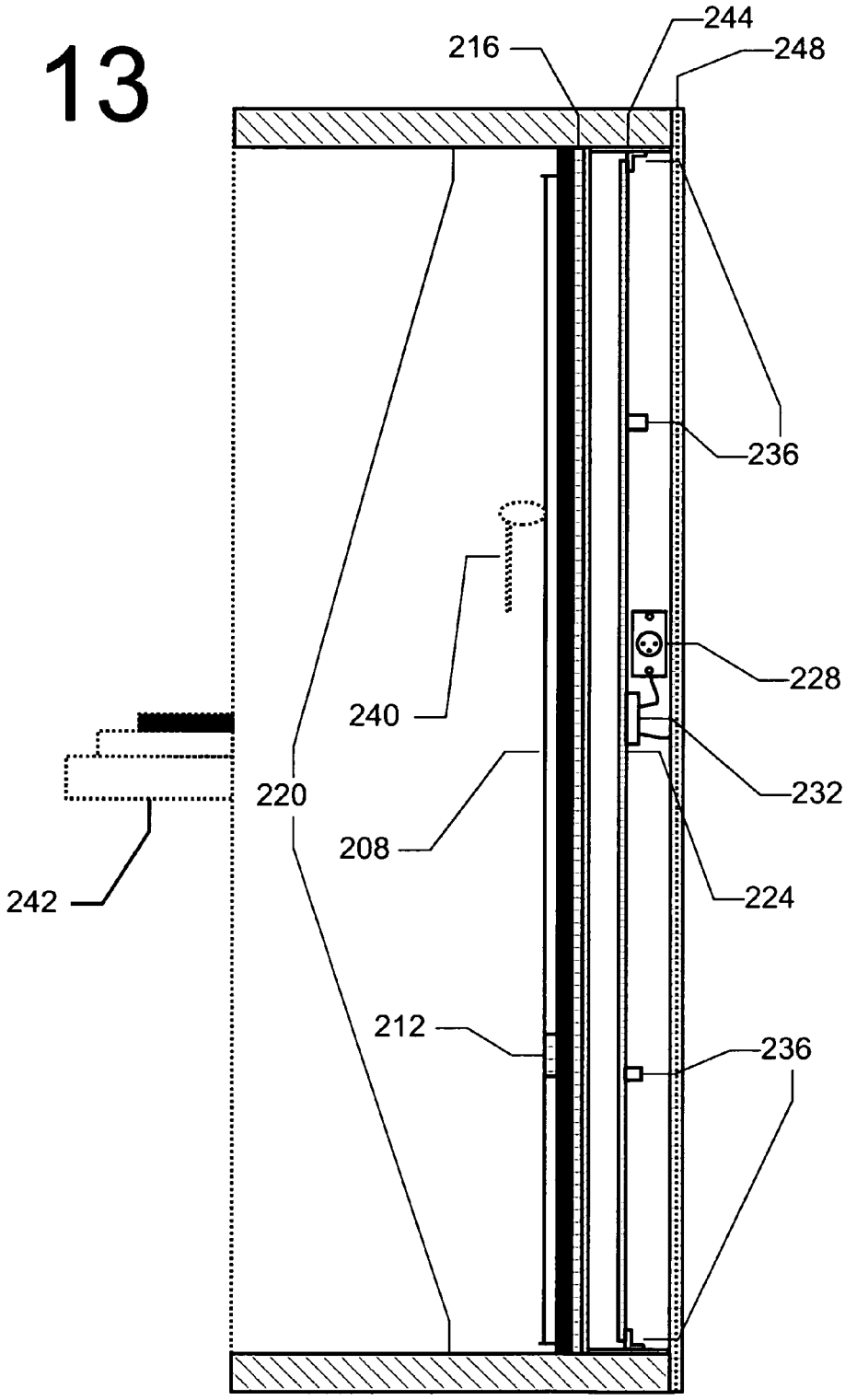
FIG. 13 is a cross-sectional view of an acoustic piano with electric vibration transducer.

FIG. 13 shows a cross-sectional view of an acoustic upright piano with electric vibration transducer, another embodiment of the invention. A pianist plays the piano by pressing keys on the keyboard 242 and moving hammers 240 by means of a complicated linkage (not shown). When the hammers 240 strike stretched strings on the instrument's harp 208, they create vibrations in said stretched strings which are propagated to a soundboard 216 through a bridge 212 mounted on said soundboard 216. Soundboards are typically made of a material such as spruce, and are largely responsible for the sound of a piano (again, vibrating strings are too small to have much direct influence on the surrounding air). The harp 208 is mounted to the soundboard 216 at its perimeter, and both piano pieces are attached to the piano's support frame 220, generally made of wood. As with the acoustic guitar mentioned above, the basic instrument construction details are unchanged from the traditional methods generally used. The differences will now be discussed.

FIG. 13 also shows that the back of the soundboard 216, and the inside of the support frame 220 behind it, are covered with a vibrating variable capacitor plate 244, made in this embodiment from 1 mil aluminum foil and secured to the soundboard 216 and support frame 220 with an adhesive. A conductive mesh backing 248 is attached to said support frame 220 at the back of the piano, enclosing a cavity between the mesh backing 248 and the soundboard 216. The mesh backing 248 in this embodiment is made of an aluminum screening material like that used on many screen doors, and is stretched taut across the back of the piano and fixed in place with fasteners like staples or wood screws. Note that the vibrating variable capacitor plate 244 and mesh backing 248 are in physical contact, forming an electrical connection between the two. Also note that the mesh backing 248, being porous, largely allows sound to pass through it. A collector grid assembly 224 is placed in the cavity parallel to the soundboard 216 and in close proximity (approximately ½ inch in this embodiment), held in position by screws (not shown) attached to a series of L-shaped mounting brackets 236 mounted on the inside of the support frame 220. Note that there is no electrical contact between the collector grid assembly 224 and the vibrating variable capacitor plate 244, as these two parts form a parallel plate variable capacitor and are held at different voltages. In this embodiment, the electric circuit board 232 is a printed circuit board containing all of the necessary electrical circuitry for the electric vibration transducer, and is mounted directly on the collector grid assembly 224 with standoffs. A wire connects the electric circuit board 232 with the mesh backing 248 to provide electrical grounding, and a cable connects the electric circuit board 232 to an XLR output jack 228 for signal output and power input purposes. In this embodiment, the XLR jack is inserted in a hole in the right side of the piano's support frame 220, but other locations can be used instead.

Figure 14:
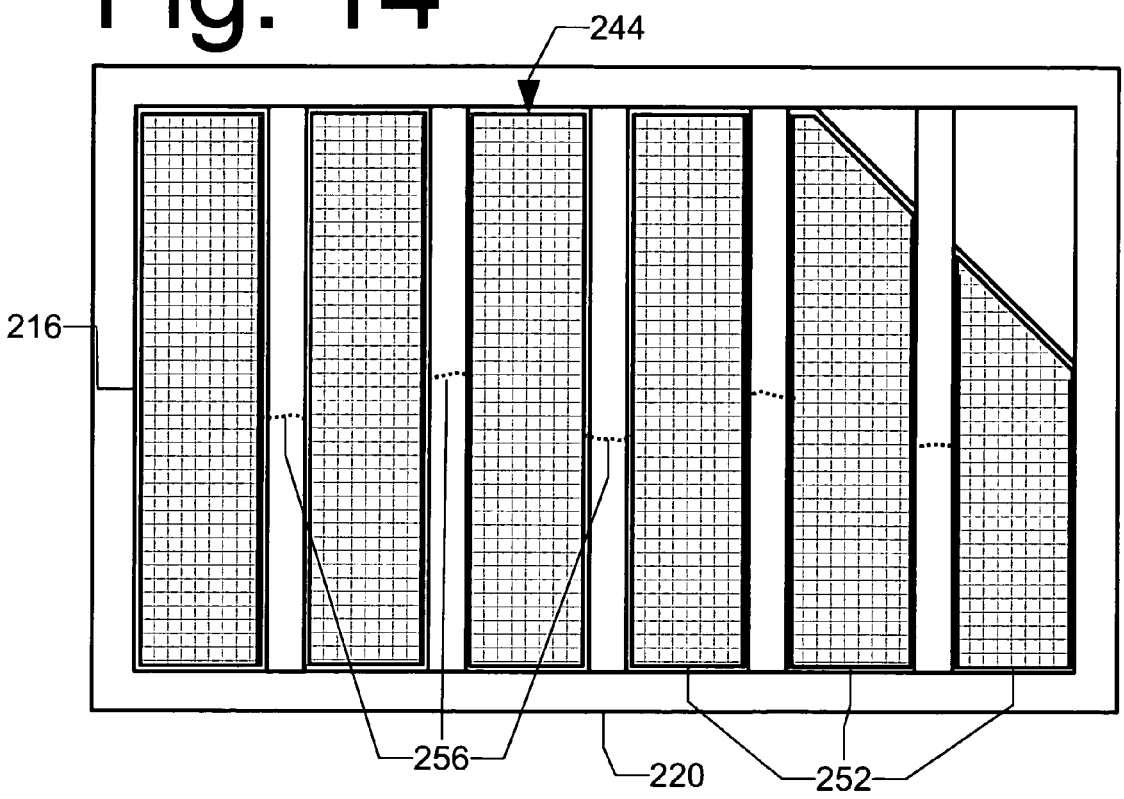
FIG. 14 is a top view of an acoustic piano sensor grid assembly.

FIG. 14 shows the back of the piano with the mesh backing 248 removed, revealing the collector grid assembly 244, which consists of multiple fixed variable capacitor plates 252 of copper mesh (in this embodiment) stretched on wooden frames of various dimensions. The fixed variable capacitor plates 252 are connected together by wires 256 so all panels are at the same DC electric potential while the instrument is not being played. Note that the panels cover most of the soundboard 216 to capture a majority of the maximum possible signal produced by the instrument.

Figure 15:
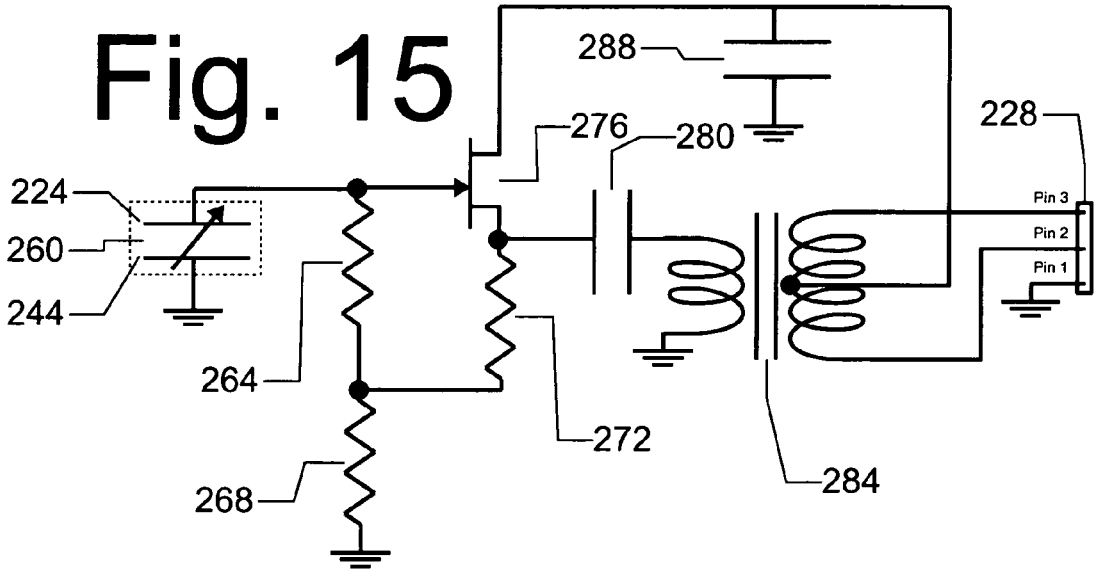
FIG. 15 is a schematic view of an electric circuit board for an acoustic piano with electric vibration transducer.

FIG. 15 shows an electrical schematic of the electric circuit board for the electric vibration transducer. The vibrating variable capacitor plate 244 covering the back side of the soundboard 216 and the fixed variable capacitor plates 252 are connected electrically to the electric circuit board 232 so they collectively become the parallel plate variable capacitor 260. The fixed plate voltage is controlled by biasing resistor 264 (here having resistance of 90 kilohms) and resistor 268 (66 kilohms), as well as the source resistor 272 (470 ohms) for the preamplifier JFET 276. In this embodiment, the preamplifier JFET is again a 2N4338, although a J201 JFET can also be used here because the biasing resistors keep the voltage across the JFET within allowable limits. In this embodiment, the voltage of the fixed variable capacitor plate is approximately 40V. The voltage variations across the variable capacitor caused during instrument play are transmitted through the blocking capacitor 280 (here a 0.01 microfarad polyester film capacitor) and through matching transformer 284 to produce a balanced signal on pins 2 and 3 of the XLR output jack 228, which is connected to a recording or amplification device, like a mixer, through a cable (not shown). Note that, as we saw with the acoustic guitar vibration transducer above, power for the transducer comes through the XLR output jack 228 in the form of an industry standard 48V DC bias on the signal output pins. This bias appears as a constant voltage on the center tap of the right winding of the matching transformer 284, and is filtered by the filtering capacitor 288 (here a 1000 microfarad aluminum electrolytic capacitor capable of withstanding 100 volts). The output signal is a balanced oscillating AC voltage of the type produced by a microphone.

As in the previous embodiments, the invention can be modified to convey the generated signal in other forms, including analog or digital signals using many different wired, wireless, or optical transmission media. Lastly, note that the preamplifier circuit can be adjusted to increase the gain to the output signal if necessary, including making the gain adjustable during instrument play.

The invention claimed is:

1. Apparatus comprising a capacitive vibration-sensitive electrical transducer having, in combination:

a. sensor means comprising a fixed variable capacitor plate further comprising an electrically conductive surface facing, placed inside, and separated from an electrically conductive cavity integrated into an acoustic musical instrument, where said electrically conductive cavity substantially comprises, in whole or in part, a vibrating surface on said acoustic musical instrument that, through its vibration, emits a substantial portion of the sound waves that characterize the sound of said musical instrument to an external listener, and where said electrically conductive cavity is free to vibrate in unison with said vibrating surface wherever said electrically conductive cavity and said vibrating surface make physical contact;

b. input and output means comprising an electric circuit, to be placed inside said electrically conductive cavity to benefit from said cavity's electromagnetic shielding properties, where said electric circuit further comprises: an audio signal AC preamplifier circuit, means to connect said electric circuit to a source of electrical power, means to connect said electrically conducting cavity to a source of electrical grounding, and means to connect said fixed variable capacitor plate to a non-oscillating electrical voltage, differing from that of the electrically conducting cavity, through a source of electrical resistance great enough to permit substantial AC voltage fluctuations at audio frequencies to occur in said fixed variable capacitor plate when said electrically conducting cavity oscillates at said audio frequencies proportional to the voltage difference existing between said fixed variable capacitor plate and said electrically conducting cavity, where said AC voltage fluctuations comprise the signal input to said audio signal AC preamplifier circuit, and;

c. means to filter the audio signal AC preamplifier output signal bandwidth and modify the output impedance of said audio signal AC preamplifier to make said audio signal AC preamplifier output signal compatible with the AC output signal of microphones or magnetic pickup devices, and further comprising means to make said audio signal AC preamplifier output available to microphone or instrument signal inputs found on audio recording and amplification equipment;

whereby said apparatus is used to reproduce the sound of said acoustic musical instrument as an electrical signal compatible with the signals generated by microphones, magnetic pickups, and other sources of audio signals used for musical recording and amplification purposes.

2. Apparatus as described in claim 1, where said fixed variable capacitor plate comprises a metallic two-dimensional surface.

3. Apparatus as described in claim 1, further comprising a series of holes in said fixed variable capacitor plate to allow for the free motion of air pressure waves within said musical instrument.

4. Apparatus as described in claim 1, where said means to make said audio signal AC preamplifier output available to microphone or instrument signal inputs comprises an audio cable jack electrically connected to the output of said audio signal AC preamplifier, where an external audio signal cable is plugged to connect said apparatus to an external audio mixing, recording, or amplifying device.

5. Apparatus as described in claim 4, where said means to connect said electrical circuit to a source of electrical power comprises means for receiving power from electrical bias on said audio signal cable.

6. Apparatus as described in claim 4, where said audio signal jack comprises a ¼" instrument jack.

7. Apparatus as described in claim 4, where said audio signal jack comprises a microphone cable connector.

8. Apparatus as described in claim 1, where said means to connect said electrical circuit to a source of electrical power comprises terminals for connecting a battery.

9. Apparatus as described in claim 1, where said means to connect said electrical circuit to a source of electrical power comprises a jack for connecting an external DC power supply.

10. Apparatus as described in claim 1, where said means to connect said electrical circuit to a source of electrical power comprises terminals for connection to an external AC power source and rectification circuitry for converting said AC power to DC power.

11. Apparatus as described in claim 1, where said means to make said audio signal AC preamplifier output available to microphone or instrument signal inputs comprises an analog to digital converter (ADC) and means to transmit its signal to external devices.

12. Apparatus as described in claim 11, where said means to transmit said ADC's output comprises a jack for connecting an appropriate signal cable.

13. Apparatus as described in claim 11, where said means to transmit said ADC's output comprises an optoelectric circuit that converts the output signal of said ADC to an optical signal physically connected to an output port for said optical signal to exit said musical instrument.

14. Apparatus as described in claim 1, where said means to make said audio signal AC preamplifier output available to microphone or instrument signal inputs comprises a radio circuit that converts the output signal of said audio signal AC preamplifier to a radio frequency signal, further comprising an antenna for said radio signal to exit said musical instrument.

15. Apparatus as described in claim 1, where said fixed variable capacitor plate is shaped to fit inside the shells of acoustic drums.

16. Apparatus as described in claim 1, where said fixed variable capacitor plate is shaped to fit inside the hollow body of acoustic stringed instruments.

17. Apparatus as described in claim 1, where said fixed variable capacitor plate is shaped to fit inside an electrically conducting cavity attached to a soundboard.

18. Apparatus as described in claim 17, where said electrically conducting cavity is attached to the soundboard of a piano.

* * * * *